United States Patent [19]

Adkins

[11] Patent Number: 4,716,880

[45] Date of Patent: Jan. 5, 1988

[54] HAND HELD CROSSBOW

[76] Inventor: Glenn H. Adkins, 12026 Fidel Ave., Whittier, Calif. 90605

[21] Appl. No.: 903,520

[22] Filed: Sep. 4, 1986

[51] Int. Cl.[4] ..... F41B 5/00

[52] U.S. Cl. ..... 124/25; 124/35 R; 124/40

[58] Field of Search ..... 124/25, 31, 35 R, 35 H, 124/40, 21

[56] References Cited

U.S. PATENT DOCUMENTS

| | | | |
|---|---|---|---|
| 228,302 | 6/1880 | Beard | 124/35 A |
| 1,133,189 | 3/1915 | Shannon | 124/35 R |
| 2,526,369 | 10/1950 | Kieselhorst | 124/23 R |
| 2,918,050 | 12/1959 | Kopman | 124/40 |
| 3,139,692 | 7/1964 | Sellers et al. | 124/40 |
| 3,788,299 | 1/1974 | Mathews | 124/35 R |
| 4,030,473 | 6/1977 | Puryear | 124/35 R |
| 4,206,740 | 6/1980 | Lydon | 124/25 |

*Primary Examiner*—Richard J. Scanlan, Jr.
*Assistant Examiner*—Peter M. Cuomo
*Attorney, Agent, or Firm*—Edgar W. Averill, Jr.

[57] ABSTRACT

A hand held crossbow. The crossbow has a frame including a handle and a barrel. The crossbow holds an arrow by gripping the back end of the arrow against the top of the barrel. This gripping holds the arrow in place without any necessity of restraining the bow string. The crossbow is fired by releasing the gripper from the back of the arrow.

17 Claims, 6 Drawing Figures

FIG. 1.
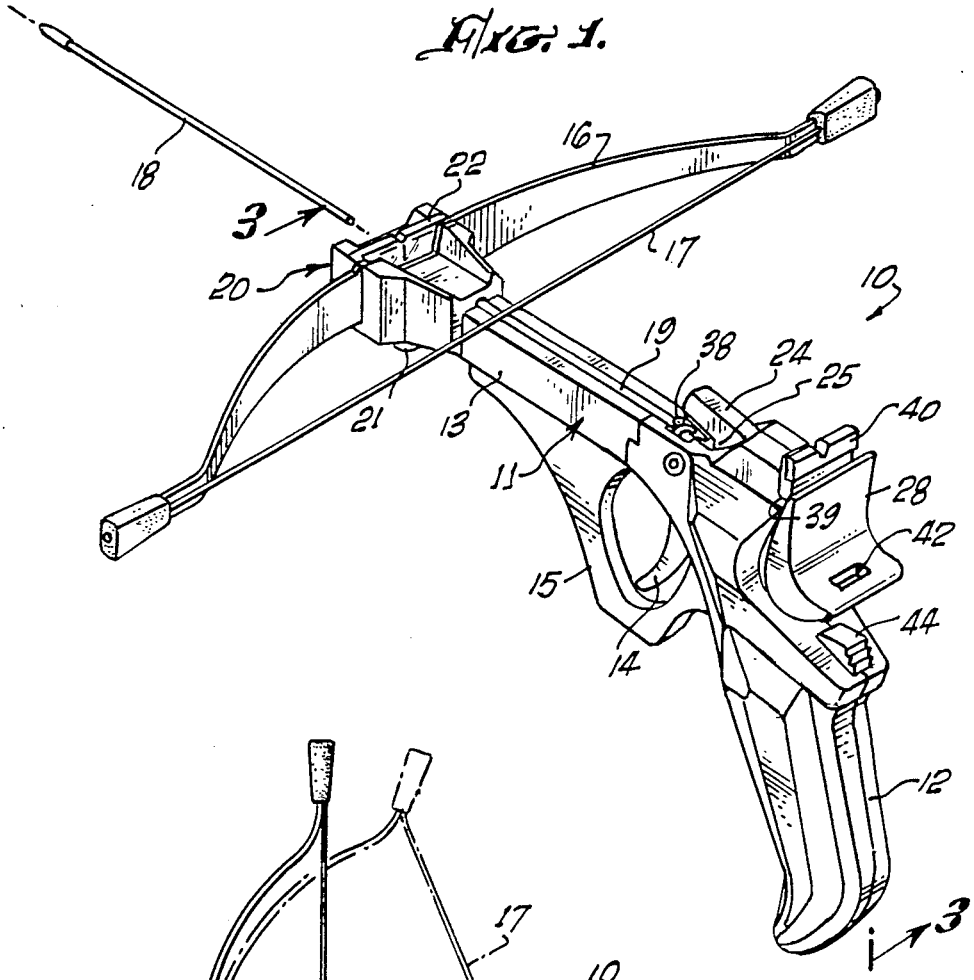
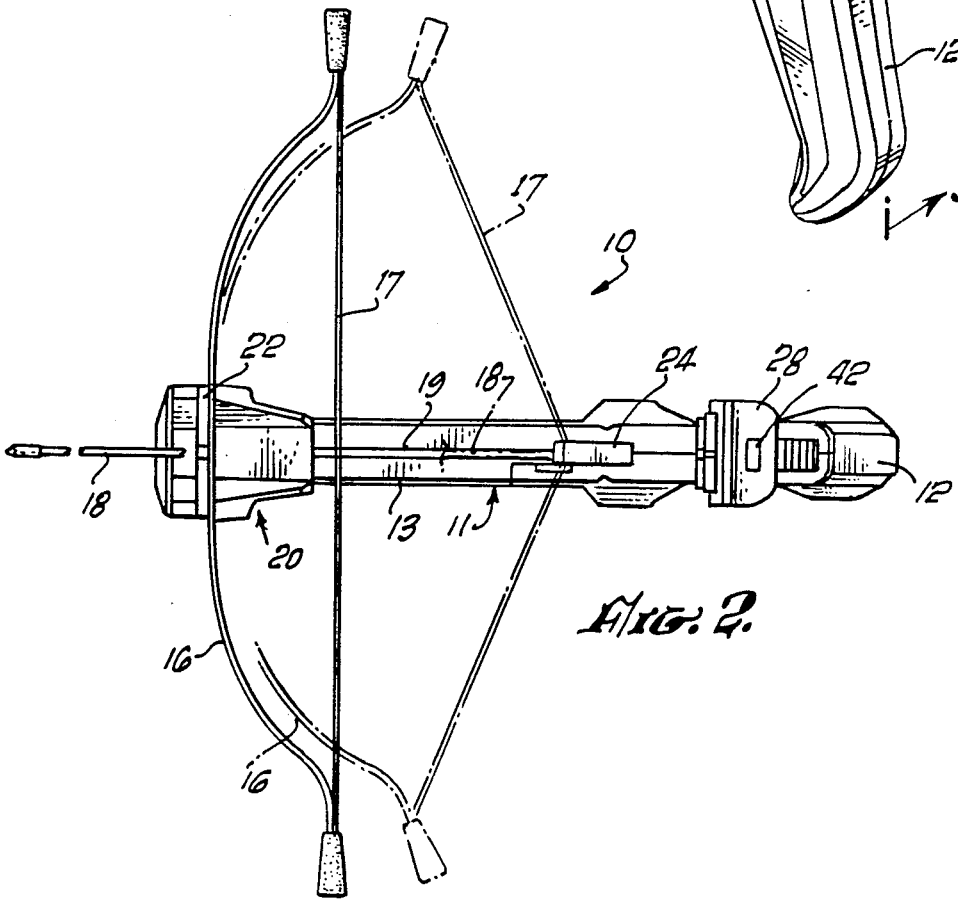
FIG. 2.

HAND HELD CROSSBOW

BACKGROUND OF THE INVENTION

The field of the invention is sporting goods and the invention relates more particularly to crossbows.

Most crossbows are fired by releasing the string thereof. Typically, as disclosed in U.S. Pat. Nos. 2,786,461; 3,788,299 and 4,294,222, the bow string is held by a retainer wheel which has an arrow-holding notch in the periphery thereof and which is allowed to rotate when the trigger is pulled. There are also many crossbow patents which have a hook which restrains the bow string and which is moved either upwardly or downwardly, releasing the bow string. Such a triggering device is shown in U.S. Pat. Nos. 2,554,966; 3,224,427; 3,538,901; 4,030,473; 4,206,740 and 4,388,914.

Because of the substantial force which may be generated by a crossbow, the holding of the bow string creates a substantial point of wear of the bow string. Furthermore, the releasing of the bow string by moving a hook upwardly or downwardly can decrease the accuracy of the crossbow by providing an undesired downward or upward movement in the arrow. Furthermore, it is beneficial that the arrow be held in the bow, and the mere holding back of the bow string does not, by itself, accomplish this result. Thus, once the crossbow is cocked, the arrow, if not restrained, can fall out of the crossbow if it is pointed downwardly.

SUMMARY OF THE INVENTION

It is, thus, an object of the present invention to provide a crossbow which may be fired without holding the bow string thereof and which securely holds the arrow in the crossbow when the crossbow is cocked.

The present invention is for a crossbow having a crossbow frame including a handle portion and a barrel portion. The crossbow also has a bow frame affixed to the crossbow frame near the front of the barrel portion thereof. The bow frame has a bow string affixed between the tips thereof. An arrow gripper arm is held by the crossbow frame near the rear of the barrel portion. The arrow gripper arm has sufficient gripping force to hold an arrow in place when the crossbow is cocked without any holding of the bow string. Trigger means are held by the cross bow frame adjacent the handle portion thereof, and the trigger means are linked to the arrow gripper means so that the pulling of the trigger means releases the arrow. Preferably, the gripper arm has an elastic pad on the gripping surface thereof. It is also preferable that the upper portion of the barrel adjacent the elastic pad on the gripper means also have an elastic pad thereon. It is also beneficial that a safety hook be provided which restrains the bow string in the event of failure of the gripper means. A beneficial means for operating the gripper arm includes a pressure plate which, when moved forwardly, closes the gripper means. The cross bow is beneficially a hand-held cross bow having surprising accuracy.

BRIEF DESCRIPTION OF THE DRAWINGS

FIG. 1 is a perspective view of the cross bow of the present invention.

FIG. 2 is a plan view thereof.

DESCRIPTION OF THE PREFERRED EMBODIMENTS

Figure 3:
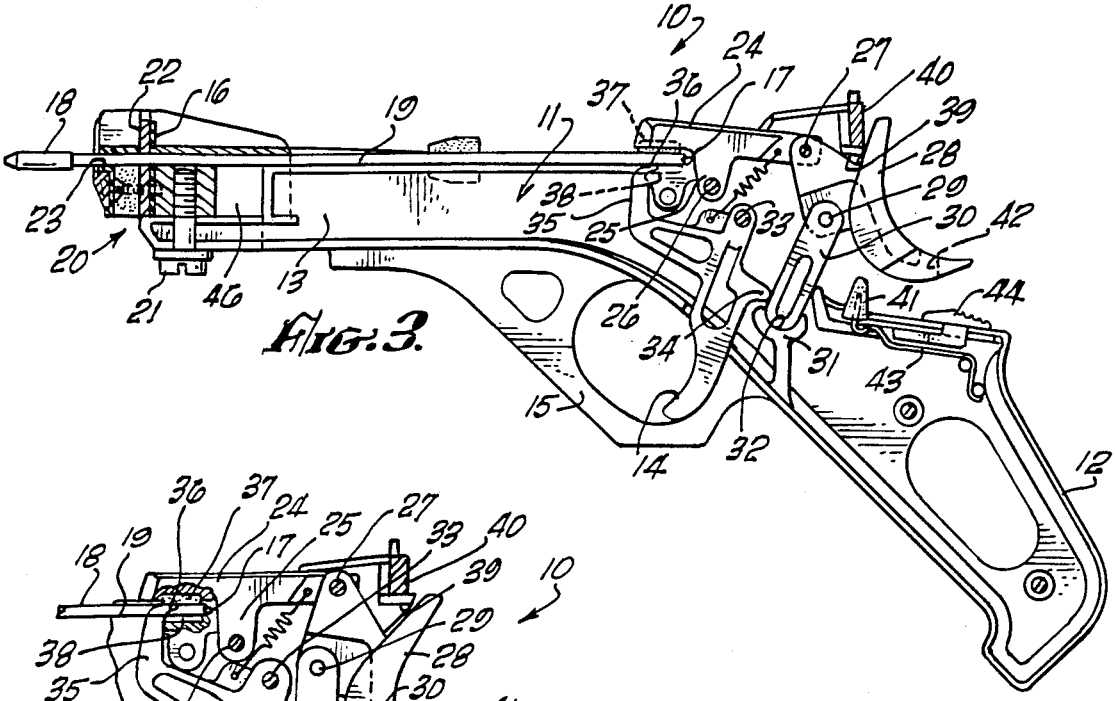
FIG. 3 is a cross-sectional view taken along line 3—3 of FIG. 1.
Figure 4:
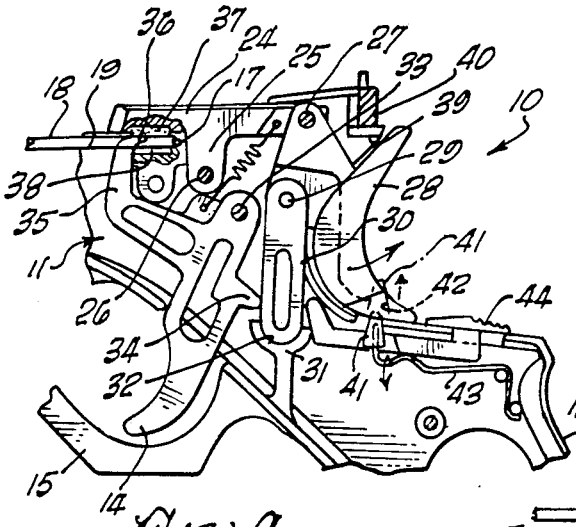
FIG. 4 is an enlarged view of the gripper means of the cross bow of FIG. 1 in a cocked configuration.
Figure 5:
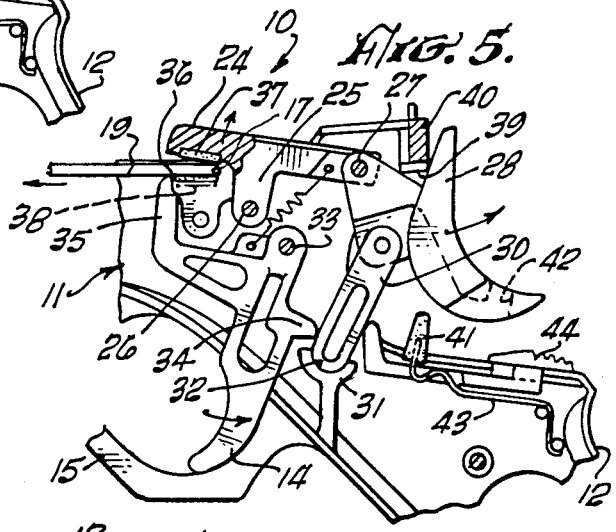
FIG. 5 is an enlarged view of the gripper means of the cross bow of FIG. 1 in a released configuration.
Figure 6:
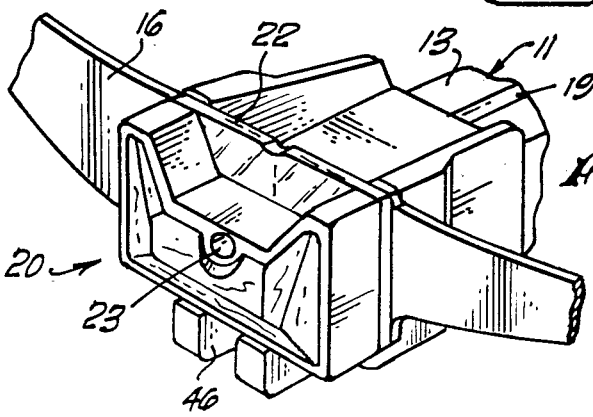
FIG. 6 is a fragmentary perspective view of the front of the cross bow of FIG. 1.

The cross bow of the present invention is shown in FIG. 1 and indicated generally by reference character 10. Cross bow 10 has a frame 11 which has a handle portion 12 and a barrel portion 13. A trigger 14 is held by the frame and is protected by a trigger guard 15.

Cross bow 10 has a bow 16 and a bow string 17 which propels an arrow 18 which is held in a groove 19 formed along the upper surface of the barrel portion 13.

The bow 16 is held in a removable bow-holding assembly indicated generally by reference character 20. Assembly 20 is held to the front of the barrel by a screw 21 shown best in FIG. 3. Assembly 20 includes a clear, plastic sight plate 22 and the arrow 18 is inserted into the cross bow through an opening 23 aligned with groove 19.

An important feature of the present invention is the manner in which the arrow is held and released from the cross bow. This is accomplished by the movement of a gripper bar 24 which has a pivot link 25 held by a pin 26 to the cross bow frame 11. The back of gripper bar 24 also has a pin 27 which links it to a pressure plate 28. Pressure plate 28 has a second pin 29 which is pivotally attached to a link arm 30. The base 31 of link arm 30 is restrained in a bearing cavity 32 which permits the forward and backward movement of pin 29 when moved either by the trigger 14 or the pressure plate 28.

Trigger 14 is held to frame 11 by pin 33. Trigger 14 also has a contact arm 34 which moves link arm 30 rearwardly when trigger 14 is pulled. Trigger 14 also has a safety arm 35 which has a safety hook 36 at its upper end. Safety hook 36 is capable of restraining the bow string 17, when the bow string is in a cocked configuration, in the event of failure of the gripper bar to hold the arrow.

In operation, the arrow 18, which has a conventional notch at the rear thereof, is inserted through opening 23 and pushed inwardly by pressing the cross bow and arrow against a surface and pushing forwardly on the cross bow. When the arrow is pushed all the way back, pressure plate 28 is moved forward and gripper bar 24 pivots about pin 26 and its undersurface abuts the end of the arrow. Preferably, gripper bar 24 has an elastomeric pad 37 on its undersurface. Also, preferably, an elastomeric pad 38 is affixed to the upper surface of the groove 19 so that the arrow may be firmly gripped without damaging the same. Typically, the arrow will be fabricated from wood, although fiberglass, metal or other materials may also be used. As trigger 14 is pulled, the safety hook 36 is first lowered from interference with bow string 17. Secondly, link arm 30 is moved rearwardly by contact with contact arm 34, thereby moving pressure plate 28 upwardly about pin 27 which causes gripper bar 24 to pivot about pin 26, releasing the upward force at pin 27 through link arm 30 which contacts the base of bearing cavity 32. It can be seen that the force generated at the elastomeric pads is substantial because of the force multiplication caused by the straightening of the line between pin 27, pin 29 and the base of bearing cavity 32. It should also be noted that pressure plate 28 is held within the cross bow by contact with the undersurface 39 of plate holding member 40.

In addition to the safety provided by safety hook 36, a second safety prevents the pulling of the trigger when the second safety has not been released. This is accomplished by the contact of safety latch 41 with safety latch cavity 42 formed in pressure plate 28. Safety latch 41 is held in place by a safety spring 43. It can be seen that the forward movement of safety release 44 moves safety latch 41 downwardly and permits pressure plate 28 to move upwardly when the trigger is pulled. Conversely, it can be seen that when safety latch 41 is in place in the safety latch cavity 42, that the trigger cannot be pulled because the pressure plate is not permitted to move upwardly.

Because of the location of pressure plate 28, it can be readily operated by the user's thumb when the arrow has been fully inserted. Furthermore, it can be seen that the downward movement of pressure plate 28 urges safety latch 41 into safety latch cavity 42. It can further be seen that the rearward movement of link arm 30 abuts the safety reset knob 45 which is integral with safety latch 41, thereby moving safety latch 41 rearwardly to permit the automatic placement of latch 41 into latch cavity 42.

The tension of the cocked bow can be adjusted by moving the bow inwardly or outwardly. This is accomplished by loosening screw 21 (see FIG. 2), moving the bow inwardly or outwardly along slot 46 and tightening screw 21 to hold the bow in its new position. The further forward the bow, the greater the bow tension when cocked.

While the cross bow of the present invention is discussed as a hand-held or pistol-like cross bow, the same principle is equally applicable to a conventional cross bow held against the user's shoulder. It can also be seen that the arrow is securely held in place when the cross bow is cocked, thereby making it unnecessary to use any other method for holding the arrow from falling out of the cross bow. It has been found that the use of a urethane elastomer for construction of pads 37 and 38 provides appropriate protection of wooden arrows, while at the same time exhibiting excellent wear. The gripping action caused by holding the end of the arrow provides a very smooth release for the arrow, while also providing excellent wear characteristics for the string. There is no sharp release of an arm against the string and, instead, the arrow is released and the string contacts only the notch of the arrow providing superior string life.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A cross bow for propelling an arrow, said cross bow comprising:

a cross bow frame including a handle portion and a barrel portion, said barrel portion having a front and a rear and a top surface including a top surface area;

a bow frame having two tips, said bow frame affixed to the cross bow frame near the front of the barrel portion thereof, said bow frame having a bow string affixed between the tips thereof;

an arrow gripper arm held by said cross bow frame near the rear of the barrel portion, said arrow gripper arm including a gripping surface, said arrow gripper arm having sufficient gripping force to hold an arrow in place in the cross bow when the cross bow is cocked, and the bow string is a cocked bow string, without any holding of the bow string other than by an arrow; and pullable trigger means held by said cross bow frame adjacent the handle portion thereof, said trigger means being linked to said arrow gripper means so that the pulling of the trigger means releases said gripper means.

2. The cross bow of claim 1 wherein said arrow gripper arm has an elastic pad on the gripping surface thereon.

3. The cross bow of claim 1 wherein said gripper arm holds an arrow against the top surface of the barrel portion of the cross bow frame.

4. The cross bow of claim 3 wherein the top surface area of the barrel portion of the cross bow frame which is adjacent the gripper means has an elastic pad thereon.

5. The cross bow of claim 1 further including a bow string safety hook held by said cross bow frame at the rear of the barrel portion and safety hook being operated by the trigger means to lower the safety hook below the cocked bow string before the gripper means is released.

6. The cross bow of claim 5 wherein said bow string safety hook is integral with said trigger means.

7. The cross bow of claim 1 further including a pressure plate, capable of moving forward, affixed to said cross bow frame above the handle portion thereof, said pressure plate being linked to said gripper means so that the moving forward of said pressure plate causes said gripper means to close.

8. The cross bow of claim 7 wherein said gripper means is generally horizontal bar having a midpoint, a front gripping end and a rear end and having a pivot link affixed to said cross bow frame near the midpoint of the bar, said bar being pivotally linked to said pressure plate at its rear end and said pressure plate having a link arm pivotally attached to a mid portion thereof, said link arm having its base confined by said cross bow frame so that the moving forward of the pressure plate moves the rear end of the bar upwardly and thus moves the front gripping end downwardly.

9. The cross bow of claim 8 wherein said trigger means moves the end of the link arm which is attached to said pressure plate rearwardly when said trigger means is pulled back, thereby moving the rear end of said bar downwardly and the front gripping end thereof upwardly.

10. The cross bow of claim 7 further including a safety latch holding said pressure plate in a forward position until said safety latch is released.

11. The cross bow of claim 10 wherein said safety latch comprises a finger which moves into and out of an opening in said pressure plate and holds said pressure plate in a forward position when said finger is in the opening in said pressure plate and allows said pressure plate to move rearwardly when said finger is out of said opening.

12. The cross bow of claim 1 further including an arrow holding plate mounted at the front of said barrel portion, said arrow holding plate having an opening for inserting an arrow into said cross bow.

13. The cross bow of claim 1 wherein said bow frame is held by a bow frame mounting assembly which is removably affixed to the front end of said barrel portion.

14. A hand held cross bow for propelling an arrow, said cross bow comprising:

a cross bow frame including a handle portion and a barrel portion, said barrel portion having an upper surface, a front end and a rear end and said barrel portion having an arrow holding plate mounted at the front end thereof, said arrow holding plate having an opening for inserting an arrow into said cross bow;

a bow frame having two tips, said bow frame being affixed to the cross bow frame near the front end of the barrel portion thereof, said bow frame having a bow string affixed between the tips thereof.

an arrow gripper arm held by said cross bow frame near the rear of the barrel portion, said arrow gripper arm having a front end including an under side and a rear end and being mounted above the barrel portion and having an elastic pad mounted on the under side of the front end thereof and said arrow gripper arm having sufficient gripping force to hold an arrow in place in the cross bow when the cross bow is cocked without any holding of the bow string other than by an arrow; and pullable trigger means held by said cross bow frame adjacent the handle portion thereof, said trigger means being linked to said arrow gripper means so that the pulling of the trigger means moves the front end of the gripper arm upwardly and releases said gripper means.

15. The hand held cross bow of claim 14 wherein said barrel includes an elastic pad on the upper surface thereof adjacent the elastic pad on the gripper means so that an arrow may be held at its inner end between the two elastic pads.

16. The hand held cross bow of claim 14 wherein the elastic pad is fabricated from a urethane elastomer.

17. The hand held cross bow of claim 15 wherein the two elastic pads are fabricated from a urethane elastomer.

* * * * *